United States Patent [19]

Machanian

[11] 4,024,786

[45] May 24, 1977

[54] ELECTRONIC MUSICAL INSTRUMENT USING INTEGRATED CIRCUIT COMPONENTS

[75] Inventor: William V. Machanian, Lewiston, N.Y.

[73] Assignee: The Wurlitzer Company, Chicago, Ill.

[22] Filed: July 25, 1975

[21] Appl. No.: 599,166

Related U.S. Application Data

[63] Continuation of Ser. No. 475,448, June 3, 1974, abandoned.

[52] U.S. Cl. ..... 84/1.01; 84/1.23; 84/DIG. 23

[51] Int. Cl.[2] ..... G10H 1/00; G10H 5/06

[58] Field of Search ..... 84/1.01, 1.17, 1.22, 84/1.23, DIG. 7, DIG. 8, DIG. 11, DIG. 23

[56] References Cited

UNITED STATES PATENTS

| | | | |
|---|---|---|---|
| 3,236,931 | 2/1966 | Freeman | 84/1.23 |
| 3,505,461 | 4/1970 | Omura et al. | 84/1.01 |
| 3,534,144 | 10/1970 | Ring | 84/1.01 |
| 3,535,429 | 10/1970 | Uchiyama | 84/1.01 |
| 3,590,131 | 6/1971 | Reyers | 84/1.01 X |
| 3,626,076 | 12/1971 | Uchiyama | 84/1.23 |
| 3,636,231 | 1/1972 | Schrecongost et al. | 84/1.23 |
| 3,715,443 | 2/1973 | Ishimura | 84/1.01 |
| 3,735,012 | 5/1973 | Hirano | 84/1.01 |
| 3,748,944 | 7/1973 | Schrecongost | 84/1.22 |
| 3,755,609 | 8/1973 | Millet et al. | 84/1.23 |
| 3,821,458 | 6/1974 | Schreier | 84/DIG. 23 |

OTHER PUBLICATIONS

R. G. Hibberd, Integrated Circuits, McGraw-Hill Book Co., Copyright 1969, pp. 1–12.

*Primary Examiner*—Stanley J. Witkowski
*Attorney, Agent, or Firm*—Olson, Trexler, Wolters, Bushnell & Fosse

[57] ABSTRACT

The embodiment of the invention disclosed herein is directed to an electronic keyboard musical instrument wherein all the audio frequency signal information is derived from an oscillator multi-frequency generator and frequency divider circuits formed by large scale integrated circuits. The divider circuits associated with various keys of the keyboard generate tone signal information for each of the particular notes of the various octaves. The integrated circuit unit has a plurality of frequency input terminals arranged for connection to the multi-frequency generator and a plurality of second input terminals arranged for connection to its associated key switch on the keyboard of the musical instrument. Actuation of the key switch on the keyboard will enable gate circuits to transfer output signal information from the associated divider into the audio-amplifier stages of the electronic musical instrument.

24 Claims, 22 Drawing Figures

RD
FF
FF
140
160
141
142
143
147
149
144
148
146
151
152
153
154
155
156
178
162
161
KC
B+

RD
FF
FF
166
167
170
169
172
176
171
173
177
174
151
152
153
154
155
156
181
B+
KC
168

RD
FF
FF
186
187
189
191
193
196
190
194
197
192
201
202
203
208
209
210
151
152
153
154
155
156
211
KC
188
B+

RD
FF
FF
214
215
218
220
222
224
219
223
226
221
230
231
232
236
237
238
151
152
153
154
155
156
236
B+
KC
216

RD
FF
FF
237
238
B+
240
242
243
247
241
244
246
KC
257
239
KC
161
258
259
253
254
255
260
261
262
248
151
152
153
154
155
156

RD
FF
FF
263
264
B+
267
269
270
273
268
271
272
274
279
280
281
286
287
288
KC
168
KC
266
151
152
153
154
155
156

290
291
293
304
RD
296
305
295
FF
299
306
298
294
310
FF
297
311
300
312
KC
188
KC
292
292
B+

313
RD
317
316
325
FF
318
326
319
320
327
FF
321
KC
216

330
RD
333
332
342
FF
334
343
336
337
344
FF
338
239
KC

348
RD
353
352
361
FF
354
362
356
357
363
FF
350
266
351
KC

RD
366
373
370
379
FF
371
380
374
372
381
FF
368
375
292
KC 386
388
FF
384
RD
387

F/2
E/2
614
612
613
611
610
609
608
607
606
605
604
603
602
601

MFG
16
F
E
D#
D
C#
C
B
A#
A
G#
G
F#
368
350
338
321
301
302
303
277
278
276
257
259
258
236
211
181
162
KC
151
152
153
154
155
156
UM
LM
291
292
264
266
238
239
215
216
187
188
167
168
160
161
C
B
A#
A
G#
G
F#
C (E)
B (D#)
A# (D)
A (C#)
G# (C)
G (B)
F# (A#)

ELECTRONIC MUSICAL INSTRUMENT USING INTEGRATED CIRCUIT COMPONENTS

REFERENCE TO RELATED APPLICATIONS

This is a continuation application of Ser. No. 475,448, filed June 3, 1974, and now abandoned.

BACKGROUND OF THE INVENTION

This invention relates generally to electronic musical instruments, and more particularly to electronic organs and the like, wherein a multi-frequency generator is used to generate a plurality of frequencies corresponding to the plurality of frequencies associated with one octave of a musical keyboard. Musical frequencies of other octaves, either higher in frequency or lower in frequency, are generated by multiplication or division of the base frequency obtained from the multi-frequency generator.

Electronic organs have become relatively common in the musical industry and provide means for simulating the sounds produced from larger wind operated pipe organs and the like. Such electronic organs differ from one another substantially in certain specific respects, such as whether the tone produced from the organ is obtained by a tone generator associated with additive or subtrative circuits. They also differ as to the specific type of generator used to obtain the base frequencies, as for example, whether they are transistor or tube oscillators, wind-driven reed elements, rotating tone wheels, and the like. However, all of these electronic organs can be distinguished by certain common features. In particular, each organ has a plurality of tone generators, there being one tone generator for each note of the keyboards associated with a two-manual organ. Furthermore, associated with the less expensive types of electronic organs there is a single tone generator associated with the pedal tones, these tones being derived by one or more divider circuits which divide the frequency from the keyboard. However, only one pedal note at a time can be played with this type of circuit so therefore, only one tone generator is needed.

It will be immediately apparent that there is a rather significant redundancy of tone generators used in prior art types of electronic organs. However, since the maximum number of notes that normally can be played at any one time is twelve, one note for each finger of the two hands and one note for each foot when manipulating the foot pedals, there are a multitude of tone generators that are not in use. In popular organ playing, it is unusual to use more than one pedal tone at a time and it is to be expected that no more than perhaps five notes will be played at any one time by the fingers of both hands. Some effort has been made to reduce the redundancy of tone generators needed by using turnable oscillators, wherein an oscillator is shared with two or three adjacent notes on the keyboard. This is done under the presumption that only one of these notes will be played at any one time. The presumption does not always hold true however, and this is at best a low cost approach to developing electronic musical instruments of this type. However, there are still more tone generators needed that can be utilized at any one time.

In any event, the oscillator or other tone generators provide an audio frequency oscillation which bears a direct relation to the frequency of the note being played. In the case of subtractive type organ circuits, the note generated in the fundamental of the note played. In this case a large number of harmonics are provided by the generator, and the undesired harmonics are filtered out in accordance with the organ stop then being used. On the other hand, in the case of additive orgain circuits, the tone generated may be a sub-harmonic of the tone played and this sub-harmonic is then multiplied to achieve the desired frequency.

All of the electronic organ circuits heretofor utilized have been of the type which require discrete active and passive components formed in large chassis or secured to large circuit boards, such as printed circuit boards and the like. These discrete components may take the form of individual tubes or transistors as well as including inductance and capacitance elements which provide the necessary LC circuits for the oscillators. This type of prior art configuration and any of the above types of organ arrangements is relatively expensive to manufacture, and furthermore, requires a substantial amount of maintenance over the life of the organ. As well as corrective and preventative maintenance, occasional tuning of the oscillator circuit is required to maintain the organ tone qualities in tune.

SUMMARY OF THE INVENTION

Accordingly, it is an object of this invention to provide a new and improved electronic organ musical instrument circuit arrangement which can have the major portion thereof formed as an integrated circuit component and, which is completely free of tuned circuits requiring inductance and capacitance such as that used in oscillator circuits.

Another object of this invention is to provide a new and improved electronic musical instrument wherein a clock generator is utilized to operate a plurality of digital circuits which, in turn, function to form the necessary audio-frequency signal information.

Many other objects, features, the advantages of this invention will be more fully realized and understood from the following detailed description when taken in conjunction with the accompanying drawings wherein like reference numerals throughout the various views of the drawings are intended to designate similar elements of components.

BRIEF DESCRIPTION OF THE DRAWINGS

FIGS. 6, 7, 8, 9, 10, 11, 14, 15, 16, 17, 18, and 19 are all on one integrated circuit as shown in FIG. 22: only the MFG is external. This circuit added to two pairs of the circuits of FIG. 1 converts a dual 37 note keyboard into a dual 44 note keyboard.

DETAILED DESCRIPTION OF THE ILLUSTRATED EMBODIMENTS

Figure 1:
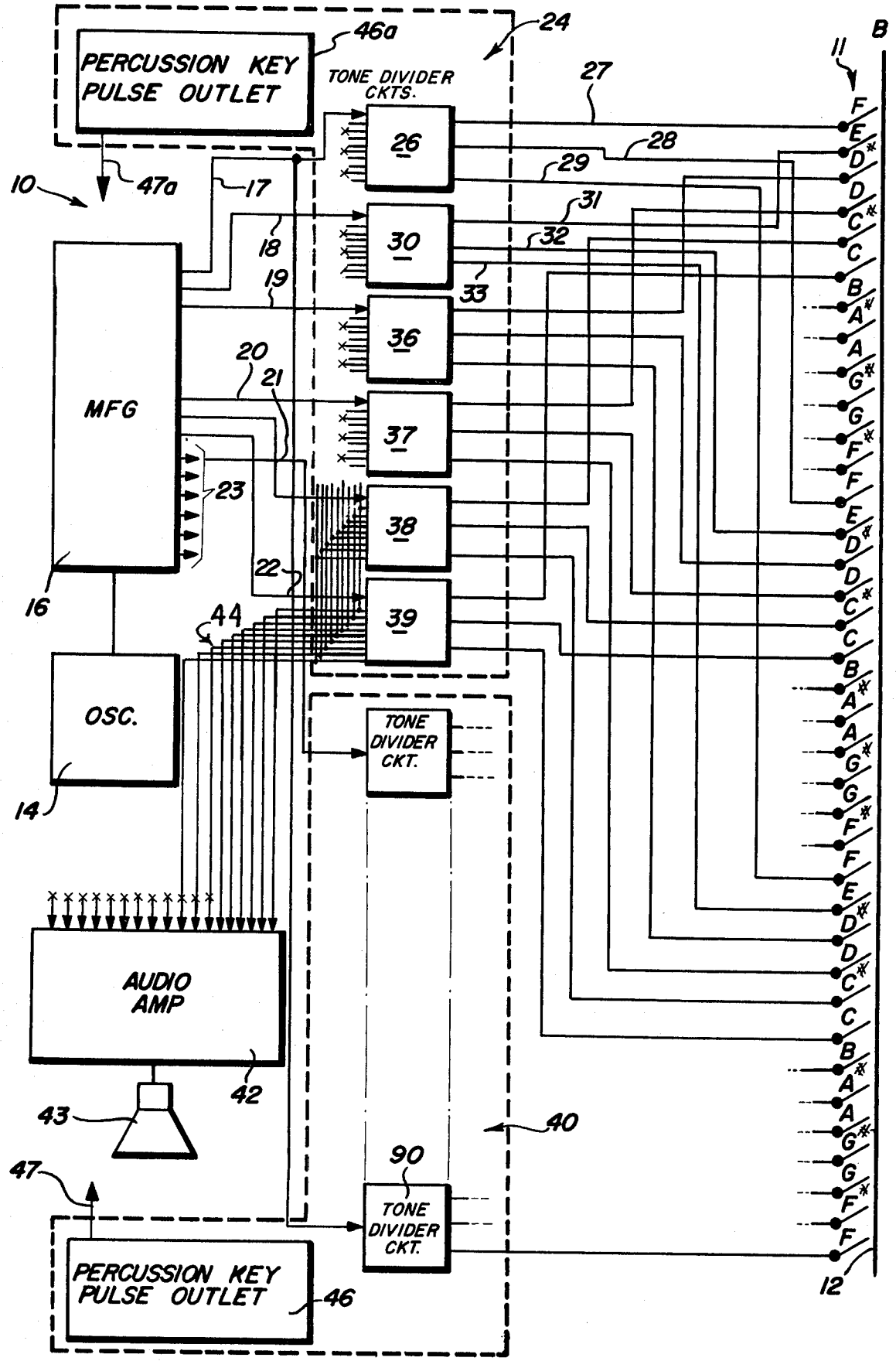
FIG. 1 is a simplified block diagram of an electronic orgain circuit utilizing large scale integrated circuit components in accordance with the principles of this invention.

Referring now to FIG. 1 is seen a simplified block diagram of an electronic organ circuit constructed in accordance with the principles of this invention and designated generally by reference numeral 10. The electronic circuit 10 includes a multitude of manually operated key switches 11 so arranged to have an electrical contactor thereof engage a bus bar 12 positioned immediately adjacent thereto. The key switches 11 represent the key on an organ keyboard. In the illustrated embodiment, the bus bar 12 may have a positive or negative voltage applied thereto, or it may be connected to a ground potential, this depending on the type of circuit. configuration being used. The particular configuration illustrated herein has the key switches 11 ranging from a high F to a low F of a musical scale providing 37 separate key switches for all of the natural and sharp notes associated with each octave. While the key switches 12 of the keyboard are here illustrated as being from F to F, it will be understood that other arrangements may be from C to C.

The circuit configuration illustrated in FIG. 1 has an oscillator circuit 14 which may operate at a frequency of about 667 kHz. However, it will be understood that other frequencies may be used for the master oscillator 14 illustrated herein. The output of the master oscillator 14 is delivered to a multi-frequency generator circuit 16 which has a plurality of internally associated divider networks which are operated by the single train of pulses delivered thereto from the oscillator 14. Preferably, the multi-frequency generator 16 has twelve independent output frequencies produced thereby which are delivered over a plurality of lines 17, 18, 19, 20, 21 and 22, which are illustrated specifically and over a plurality of lines 23 indicated collectively for purposes of simplification. The lines 23 are connected to a plurality of circuits indicated in broken lines near the bottom of the figure and which are the same as those shown in solid lines.

In accordance with the features of this invention, the output lines from the multi-frequency generator 16 are delivered to input circuits associated with an integrated circuit component 24, preferably of the large scale integrated circuit type, referred to in the art as LSI devices. The LSI device most advantageously utilized herein is obtained from Wurlitzer Company, North Tonawanda, New York, under part No. 141,097. However, it will be understood that other large-scale integrated circuit chips may be utilized. The integrated circuit 24 has associated therewith a multitude of different subgroups of circuitry which are formed from a selected plurality of active and passive electronic components. For example, the output line 17 from the multi-frequency generator 16 is delivered to a tone developing divider circuit 26 which has input lines 27, 28 and 29 associated therewith. The tone developing divider circuit also has nine output lines 44 shown going to audioamplifier 42. These signals may go through various filters. By way of example, the frequency delivered by the tone divider circuit is as follows: If key switch F is closed and this control signal goes through line 27 then the input frequency F will be delivered on output 70 (FIG. 2) and the next octave down (sub-harmonic) will be delivered on output 72 and the next lower octave on output 74. Therefore, once the initial frequency is obtained for the first note to be generated for the highest octave the sub-harmonic signals for the following two octaves are automatically obtained by dividing, or multiplying, which ever the case may be, of the main frequency obtained over the line 17.

The output line 18 of the multi-frequency generator 16 is delivered to a second divider circuit 30 which, in turn, has three input lines 31, 32 and 33 connected to the E keys of each of the three octaves illustrated. In similar fashion a corresponding plurality of divider networks 36, 37, 38 and 39 are provided and connected to the various other keys, as for example, D sharp, D, C sharp and C. This, then, provides means for generating notes for half of the notes of each octave illustrated herein.

While there are nine outputs from each of the divider circuits 26, 30, 36, 37, 38 and 39, they may be connected in common to provide a total of nine output lines from the chip 24.

A second integrated circuit unit 40 has a similarly connected plurality of divider circuits associated therewith to generate the other half of the octave and for generating a single not to provide the last F on the keyboard. Here the interconnection is illustrated just by partial broken lines for purposes of clarity so as not to overcomplicate the line drawings of the figure. It will be understood, therefore, that the circuit configuration of the second integrated circuit unit 40 is substantially identical to the circuit configuration of the integrated circuit unit 24. Also, there may be nine output lines from the chip 40. Therefore, the total number of output connections from the two chips 24 and 40 will be eighteen or again, if output frequency range can be allowed to go to one octave then the nine outputs of 24 can be connected to the nine outputs of 40 thus resulting in nine outputs. The largescale integrated circuit 40 includes a tone divider circuit 90 to be described in detail hereinbelow.

Closure of the appropriate key switch 11 will enable a gating circuit to transfer signals within each of the divider circuits illustrated so that the outputs thereof will be delivered to voicing filters and an audio-amplifier stage 42, which, in turn, is connected to a loudspeaker device 43 to energize the same. Again, for purposes of simplicity, output lines 44 are shown connected between the divider stage 39 and the audio-amplifier 42, it being understood that the same output lines are also associated between the dividers 26, 30, 36, 37 and 38.

The integrated circuit unit 24 provides means for generating eighteen notes of the musical scale illustrated while the integrated circuit 40 provides means for generating nineteen of the notes illustrated. Therefore, a total of 37 musical key notes can be obtained by the circuit configuration illustrated herein. Associated with the integrated circuit units 24 and 40 are percussion key pulse output circuits **46*a* and 46, respectively, which will sense the closure of any one of the key switches 11 resulting in a pulse signal output on line 47*a* or 47. This pulse signal will occur for each new key switch closure. Lines 47*a* and 47 are connected in common to percussion voicing filters and therefrom to audio amplifier circuit 42 for generating suitable percussion accompaniment for the electronic musical instrument illustrated herein. Output lines 47 or 47*a*** can be connected to any suitable automatic percussion rhythm device. For example, one such device which can be utilized is disclosed in U.S. Pat. No. 3,585,891 issued to Schwartz on June 22, 1971, and assigned to the same assignee of record.

Figure 2:
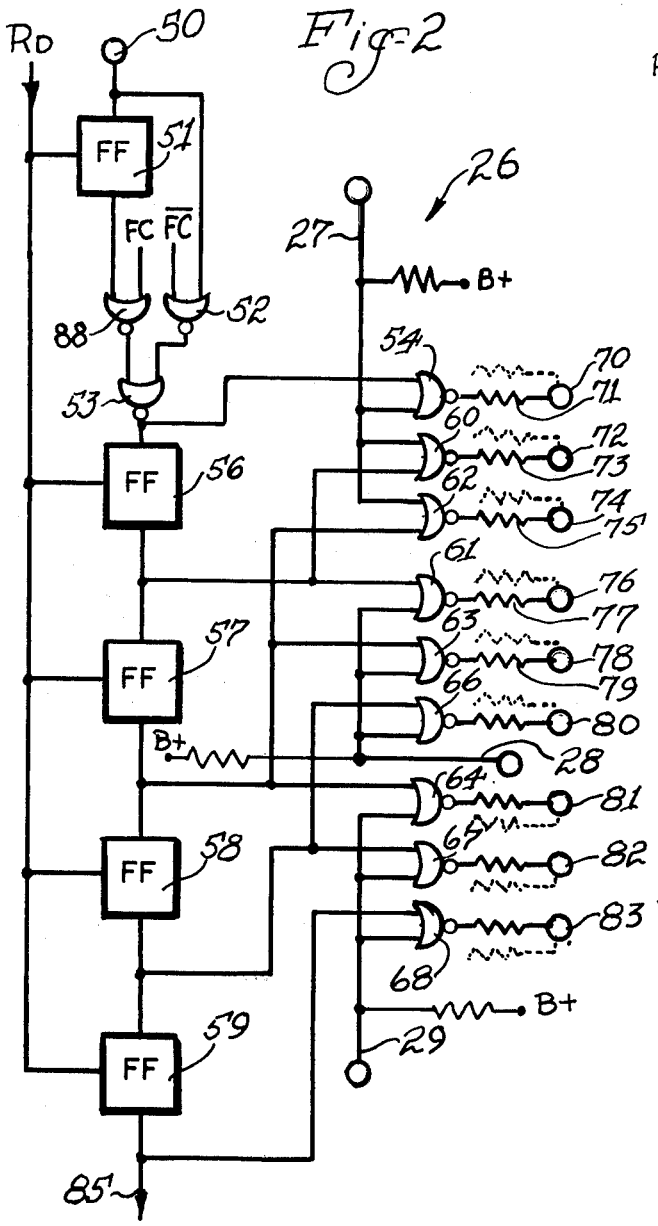
FIG. 2 illustrates one combination of elements to form a frequency divider and sub-harmonic adding circuit which is configurated in accordance with the principles of this invention, and which form one group of components on the integrated circuit chip of FIG. 1.

Turning now more specifically to FIG. 2, the divider network 26 is illustrated herein in detail, it being understood that all of the divider circuits 30, 36, 37, 38 and 39 associated with the electronic integrated circuit units 24 are constructed substantially in the same manner except for those modifications specifically illustrated herein. Also, the divider circuits of the integrated circuit chip 40 are constructed in the same manner.

The divider circuit 26 has an input terminal 50 which delivers a first fundamental frequency of the note to be developed to a flip-flop circuit 51 and NOR gate 52. The circuit 26 is so arranged to be adapted for operation by either negative D.C., i.e. zero logic or ground potential, or positive D.C., i.e. plus one logic, applied to the terminal FC. In the case of positive D.C. the signals are delivered directly through the NOR gate 52 when the FC input is high and $\overline{FC}$ input is low. This will produce an input signal to a NOR gate 53 which, in turn, applies the first fundamental frequency to the input of a NOR gate 54. The second input of NOR gate 54 is connected to the associated key switch through the line 27, this being the associated F key switch arrangement 11. The pulse through NOR gate 53 is delivered to a flip-flop circuit 56 to produce the first sub-harmonic of the tone being generated. The output of flip-flop 56 is also delivered to a second flip-flop 57 to develop still another sub-harmonic. The output of flip-flop 57 is delivered to a flip-flop circuit 58 which, in turn, has its output delivered to a flip-flop circuit 59. Therefore, the fundamental frequency at the output of NOR gate 53 is divided four times to provide four sub-harmonics thereof. The output of flip-flop 56 is tied to the input of a pair of NOR gates 60 and 61, while the output of flip-flop 57 is tied to three NOR gates 62, 63 and 64. The output of flip-flop 58 is connected to a pair of NOR gates 66 and 67 while the output of flip-flop circuit 59 is connected only to a single NOR gate 68.

It will be noted that the NOR gates associated with the outputs of the flip-flop circuits are arranged in groups so that each key switch closure will turn on three octaves of frequencies which can be called the fundamental and first and second sub-harmonics or the fundamental and second and fourth harmonics. For example, the fourth harmonic frequency of high F is delivered to an output terminal 70 through fixed resistance element 71. This occurs only when the key associated with line 27 is actuated to enable the NOR gates 54, 60 and 62. However, the second harmonic at the output of flip-flop 56 is also delivered through the second NOR gate 60 and this signal is applied to a terminal 72 through a fixed resistor 73. Finally, the fundamental for this particular note is obtained from the output of flip-flop circuit 57 and delivered through NOR gate 62 to a terminal 74 through a resistor 75. When line 27 is activated by closure of the associated key switch the audio signal information corresponding to the fundamental and the second and fourth harmonics are delivered to the output terminals 74, 72 and 70 to be amplified within the audio amplifier stage 42, Fig. 1. The corresponding output terminals of the divider circuits 30, 36, 37, 38 and 39 are preferably connected to the same common output lines which are coupled to the audio-amplifier 42.

The note for the next octave, therefore, has its fourth harmonic frequency developed at the output of flip-flop 56 and delivered to a terminal 76 through a fixed resistor 77, and the NOR gate 61. The second harmonic of this second fundamental frequency is developed at the output of flip-flop 57 and applied through NOR gate 63 to terminal 78 through a fixed resistor 79. Finally, the fundamental of this second fundamental frequency, which is the middle range octave note, is developed at the output of flip-flop 58 and is then delivered through NOR gate 66 to output terminal 80 through its associated series connected resistor. Therefore, the fundamental frequency of the note displaced one octave from the note produced at output 74 has associated therewith its corresponding second and fourth harmonics.

The fourth harmonic frequency for the similar note associated with the next octave lower is, therefore, developed at the outputs of flip-flop circuit 57 and is applied to a terminal 81 through NOR gate 64 and its associated fixed resistance element. The second harmonic of this note is developed at the output of flip-flop circuit 58 and delivered to a terminal 82 through NOR gate 67 and its associated fixed resistors. Finally, the fundamental is developed at the output of flip-flop 59 and applied to a terminal 83 through NOR gate 68 and its associated fixed resistor. Therefore, when the F note of the middle octave is desired, that associated key switch is closed to activate line 28 and enable the NOR gates 61, 63 and 66. On the other hand, if the F note of the next lowest octave is desired, that associated key switch is closed and thereby enabling line 29 and the associated NOR gates 64, 67 and 68. Associated with the divider circuit 26 is an output signal developed at line 85 which is used to develop a clock pulse used in connection with providing a reset for all the dividers of the integrated circuit. The reset is necessary to insure proper phasing between the same frequencies of two keyboards.

In the preferred embodiment the resistance value of the fixed resistance elements at the output of the NOR gates is in the order of about 20,000 ohms with respect to the positive potential, it being understood that different resistance values can be used for the respective different sub-harmonic outputs associated therewith. Furthermore, it will be understood that if the frequency control input FC is switch to a ground potential, then all of the output frequencies will drop one octave as a result of the extra flip-flop circuit 51 which adds one divide-by-two circuit in series with the other flip-flops.

Figure 4:
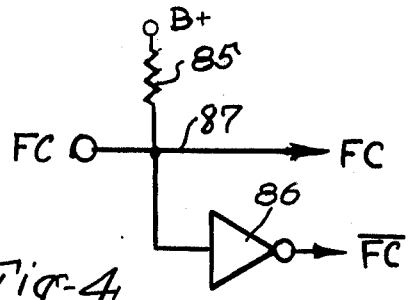
FIG. 4 illustrates a circuit for controlling the input circuits of FIGS. 2 and 3 either with positive or negative static signal information.

To achieve this broad range of control for input signals of different logic levels, the integrated circuit 24 is provided with an inverter circuit 86 which has input signals thereof received from the input line 87 to provide the inverted signal, as best seen in FIG. 4. This input is also connected to B+ through resistor 85. Therefore, with the $\overline{FC}$ potential applied to one input of NOR gate 52 and the FC potential applied to one input of a second NOR gate 88, FIG. 2, the necessary modification is obtained without requiring components to be added to the circuit after the circuit has been installed.

It will be noted that also connected to the terminals 70, 72, 74, 76, 78, 80, 81, 82 and 83 are resistance elements indicated in phantom line, which resistance elements correspond to the audio-output circuits of the other divider networks 30, 36, 37, 38 and 39 of the integrated circuit chip 24. Also, it will be understood that the audio-output terminals of the integrated circuit chip 40 may be connected in common with the audio-output terminals of the integrated circuit chips 24 so that audio signals can be mixed together and amplified in the usual manner. While phantom lines are not shown for resistors of other divider circuits, it will be understood that they may be connected in the same manner as that of FIG. 2.

Figure 3:
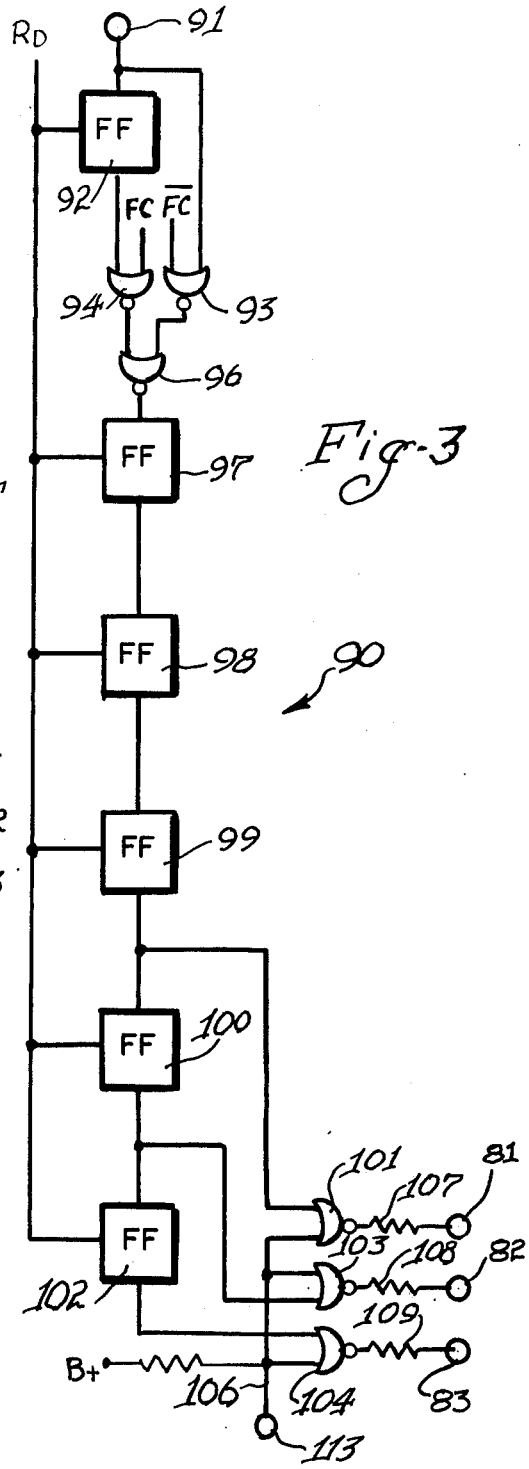
FIG. 3 illustrrates a modified form of the circuit configuration of FIG. 2 which is used to obtain one single note output therefrom, thereby allowing two independent integrated circuit chips to be used, one integrated circuit chip providing 18 tone outputs while the other integrated circuit chip provides 19 tone outputs to provide a total of 37 tone outputs for a keyboard of the electronic organ.

Referring now to FIG. 3 there is seen an alternate modification of a divider circuit constructed in accordance with the principles of this invention and which is also formed as part of the large scale integrated circuit chip. In this instance, however, the circuit configuration of FIG. 3 forms the last divider circuit 90 of the integrated circuit chip 40 to provide the last note output of the tone developing circuits. Therefore, by obtaining eighteen outputs from six frequency dividers associated with each of the integrated circuit chips and a single output from one of the frequency dividers on a circuit chip, a total of thrity-seven notes can be generated. It will be noted, however, that the circuit configuration of FIG. 3 is also formed on the integrated circuit chip 24 but is not used. Here the output signal from the multifrequency generator 16 is applied to a terminal 91 so that pulse signal information can be delivered both to a first flip-flop stage 92 and to a NOR gate 93. The output of flip-flop 92 is delivered to a second NOR gate 94 which, in turn, has its output delivered to a NOR gate 96. The output of NOR gate 93 is also connected to NOR gate 96. The function of flip-flop circuit 92 and NOR gates 93, 94 and 96 is substantially the same as that corresponding to similar components of FIG. 2.

The output of NOR gate 96 is delivered to a first flip-flop circuit 97 which forms the first divider for a series of dividers. The output of flip-flop 97 is delivered to a flip-lop 98 which in turn has its output signal delivered to a flip-flop circuit 99. The output of flip-flop circuit 99 is delivered to a flip-flop circuit 100 and to a NOR gate 101. The output of flip-flop circuit 100 is delivered to a final flip-flop circuit 102 and to a second NOR gate 103. The output of flip-flop circuit 102 is then delivered to a NOR gate 104. In this instance, the fourth harmonic frequency is that obtained from the output of flip-flop circuit 99 and delivered through NOR gate 101 when the associated key switch is depressed to energize the enabling line 106 associated with one of the inputs of the NOR gates 101, 103 and 104. The second harmonic is obtained from the output of flipflop 100 which passes through NOR gate 103. Finally, the fundamental is obtained from the output of flip-flop 102 as delivered through NOR gate 104. In similar fashion, the output of the NOR gates 101, 103 and 104 are provided with resistance elements 107, 108 and 109, respectively, to deliver the appropriate signals to the same output terminals 81, 82 and 83 of FIG. 2. The appropriate key switch is connected to the input terminal 113 which enables the NOR gates 101, 103 and 104 to effect a transfer of the signals from the divider circuit 90 to the appropriate audio-amplifier and output stages. These outputs can also be called footages instead of fundamental and second and fourth harmonics. The footages can be any three consecutive octavely related footages such as 16 feet, 8 feet and 4 feet or 5 ⅓ feet, 2⅔ feet and 1⅓ feet, etc.

Figure 5:
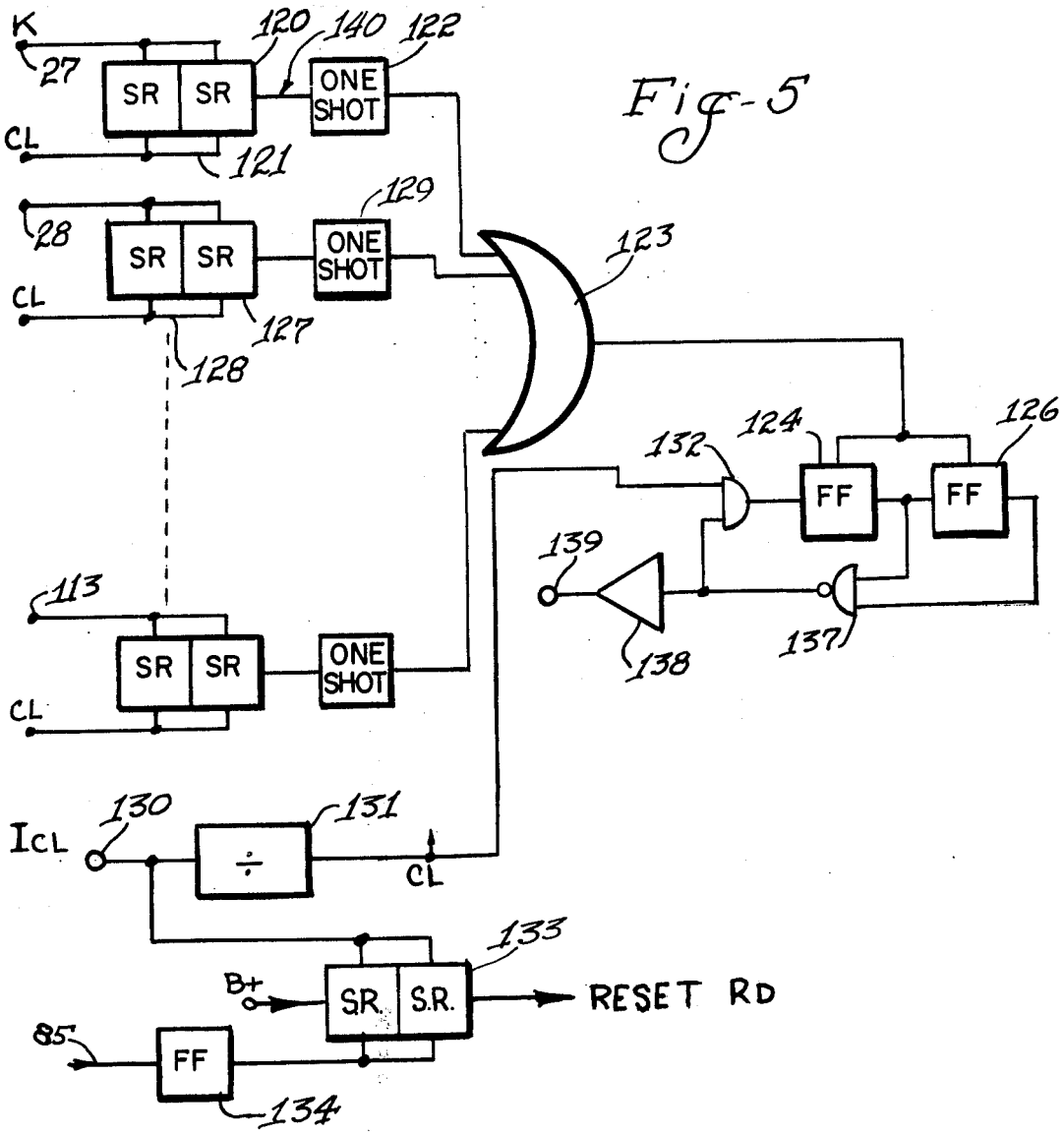
FIG. 5 is a circuit configuration which produces pulse signal information corresponding to the acutation of a key on the keyboard of FIG. 1, and which pulse signal information may be used to initiate operation of a percussive sound generating system.

Referring now to FIG. 5, there is seen a pulse output circuit also associated with the integrated circuit chip upon which is formed the plurality of divider circuits of FIG. 2 and FIG. 3. The pulse output circuit is used to produce a control outpur signal which is responsive to the actuation of any one of the keys on the keyboard and which pusle output signal is delivered to a percussion control circuit. The circuit arrangement of FIG. 5 corresponds to either the percussion key pulse outlet 46 or the percussion key pulse outlet 46*a*, of FIG. 1. Output terminal 139, therefore, corresponds to either the output line 47 or 47*a* of FIG. 1. Therefore, by utilization of this pulse output signal to control the operation of a percussive circuit arrangement a percussion organ sound can be obtained to accompany the playing of the electronic organ of this invention. To achieve this particular result, each one of the keys associated with the lines 27, 28, 29, etc. are also connected to a reset input line associated with a shift registor circuit. For example, the line 27 is associated with a shift register circuit 120 which also has connected thereto a clock pulse line 121. When the key switch associated with line 27 is closed, an output D.C. voltage change will occur on the output line 140. This output D.C. voltage change is delivered to a one-shot circuit 122 which, in turn, converts this D.C. voltage change into a short pulse. The shift register circuits are used to eliminate any problems resulting from key switch bounce. The key switch bounce occurring on key closure and again on key opening results in only the one desired pulse occurring on key closure. After the output D.C. voltage change on line 140 due to the key switch closure on line 27, the voltage will not change back on key switch opening (or key switch bounce) until two clock pulses on line 121 shift in the opposite D.C. level. This means that line 27 will have to have a "clean" key open signal for two slow clock pulses CL before the output on line 140 resets to allow for another key closure signal pulse. The output of the one-shot circuit 122 is delivered to one of the inputs of a nineteen input OR gate circuit 123 which, in turn, has its output circuit connected to the input of a pair of flip-flop circuits 124 and 126.

Similarly, the line 28 associated with the next key of the divider circuit 26 is delivered to an input of a shift register 127 which also has a clock pulse line 128 associated therewith. The output of the shift register 127 is coupled to a one-shot circuit 129 in the same manner as that of the shift register 120. The output of the one-shot circuit 129 is coupled to another one of the inputs of the nineteen-input OR gate circuit 123. Therefore, regardless of what key on the keyboard is actuated to achieve the desired note to be played each and every actuation of the keys will cause an output pulse to be generated by the pulse output circuit of FIG. 5. The timing pulse clock CL is obtained from the input clock $I_{CL}$ at the terminal 130. This clock $I_{CL}$ passes through a divide-by-eight circuit 131 which then produces the clock pulse CL used for the shift registers above and is also at one input of an AND gate 132. The output of the divider circuits 124 and 126 are coupled to a NAND gate 137 which, in turn, has its output coupled to the input of an amplifier stage 138 to produce the pulse signal output at a terminal 139. The output of NAND gate 137 is also coupled to the second input of AND gate 132. The amplifier stage 138 is preferably a single ended transistor which turns to B+ when the input is at a 1 or B+ level. When a pulse passes through OR gate 123 the pulse resets dividers 124 and 126. The two divider outputs go to 0 and thus the output of gate 137 goes to a one level turning on output 139 and allowing the clock CL to pass through gate 132 to the input of divider 124. After three counts of clock CL both outputs of the dividers will be at one level resulting in a O level at the output of gate 137 thus turning off the output at 139 and turning off the clock CL from the input of divider 124. The signal remains off until the next reset pulse occurring from OR gate 123 which occurs each time a key switch is actuated. This output signal at terminal 139 turns on for an equivalent of 17 to 24 counts of the input frequency $I_{CL}$ thus determining the output pulse width.

The clock pulse at the terminal 130 is also delivered to a shift register circuit 133 which, in turn, has a divide-by-four circuit 134 connected to the clock input thereof. The divide-by-four circuit 134 has the input terminal 136 thereof associated with the output line 85 of the divider circuit shown in FIG. 2. Therefore, this particular pulse repetition rate is substantially reduced as compared to that of the input to terminal 130. If when the electronic organ is first turned "on" the $I_{CL}$ input at 130 is held off long enough to obtain two clock pulses from divider 134 then the output of shift register 133 will turn on the divider reset signal $R_D$. This will reset all dividers shown in FIG. 2 and 3 and divider blocks 26, 30, 36, 37, 38, 39 and 90 as shown in FIG. 1. When $I_{CL}$ is allowed to start shift register 133 will reset turning off $R_D$. Thus, all dividers will start in the same state at the same time so any two outputs of the same frequency between two keyboards will always be in phase.

Referring now to FIGS. 6, 7, 8, 9, 10, 11, 14, 15, 16, 17 and 18 there is seen a plurality of tone developing circuits formed of divider networks associated with a single integrated circuit component, such as a large scale integrated circuit (LSI). Thses circuits as well as the circuits shown in FIGS. 12, 13, 19, 20 and 21 are all formed on a single LSI. In this instance there are only two audio-output groups of signals associated with each divider network. The particular circuit configuration illustrated herein allows for circuit modification of the 37 position keyboard so that addition of just one integrated circuit will extend two 37 position keyboards to two 44 note keyboards. The frequency to be divided is applied to an input terminal 140 which may form the fundamental frequency of one output signal and which is also applied to the inputs of NOR gates 141 and 149. The frequency from terminal 140 is divided by a flip-flop circuit 142 and applied to the output terminal thereof where it is delivered to a pair of NOR gates 143 and 144. Also, the output of flip-flop 142 is delivered to a flip-flop 146 which, in turn, has its output associated with a pair of NOR gates 147 and 148. It will be noted that the frequency output from the output terminals 151, 152 and 153 are substantially the same as the frequency output from terminals 154, 155 and 156. However, the key used to acrtuate the NOR gates associated with these output terminals is different. For example, the key switch associated with NOR gates 141, 143 and 147 may be connected to a terminal 160, which may be associated with one of the upper manual key switches while the key switch associated with NOR gates 149, 144 and 148 may be associated with a terminal 161 which, in turn, is connected to an OR gate 162. The other input of OR gate 162 is associated with a lower manual key switch input. The integrated circuit chip upon which the circuits of FIGS. 6–22 are formed will have as many as seven upper and seven lower manual switch inputs and associated pulse circuitry to convert two 37 note keyboards to two 44 note keyboards.

Figure 7:
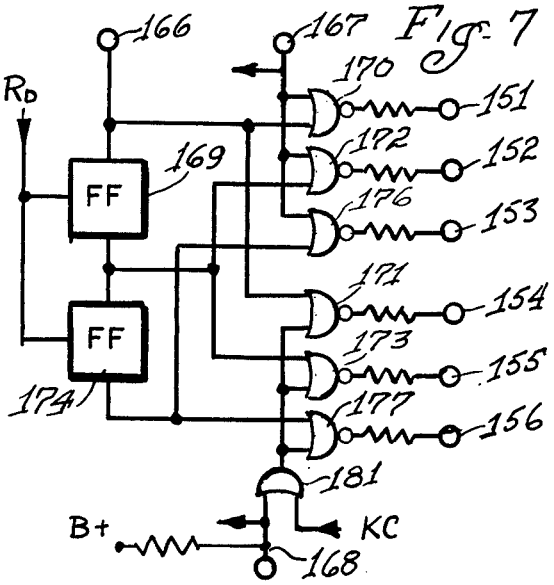
FIG. 7 is an alternate circuit configuration of FIG. 6, and which can be formed on the same integrated circuit chip therewith.

FIG. 7 illustrates still another type of divider network which is formed of the single integrated circuit chip. Here the input frequency is applied to a terminal 166 while the key switch input terminals are designated by reference numerals 167 and 168. The input frequency at terminal 166 is delivered to a divider flip-flop 169 and to a pair of NOR gates 170 and 171. The output of flip-flop 169 is delivered to a pair of NOR gates 172 and 173 and to the input of a second flip-flop circuit 174. The output of flip-flop circuit 174 is delivered to the NOR gates 176 and 177. The NOR gates 170. 172 and 176 are enabled by actuation of a key associated with terminal 169. This will apply the fundamental and two or three footage frequencies) harmonic frequencies of the audio signal to the output terminals 153, 152 and 151. On the other hand, NOR gates 171, 173 and 177 are enabled as a result of actuation of a key associated with terminal 168, which, in turn, passes through an OR gate 181. This will cause the audio-frequency signal which is generated to be delivered to the output terminals 154, 155 and 156. Here again, it will be noted that the outputs of the NOR gates are delivered to the output terminals through a passive resistance element associated with the integrated circuit. Preferably the resistance value of all of the resistors is the same, this being in the order of about 20,000 ohms.

Figure 8:
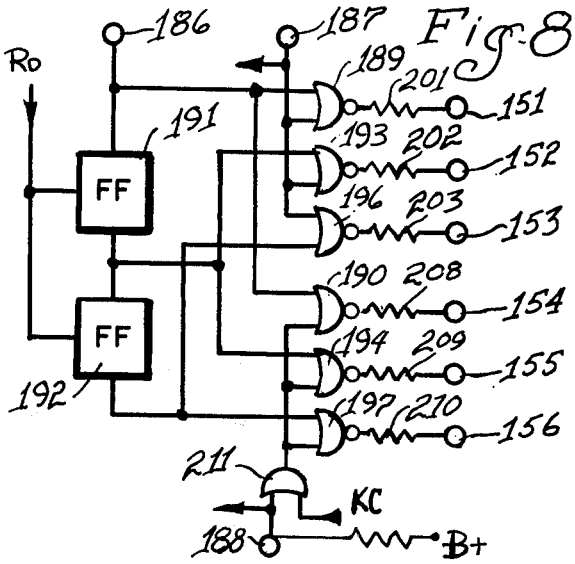
FIG. 8 is still another alternate circuit configuration which can be formed on the same integrated chip.

Referring now to FIG. 8 there is seen still another divider network constructed in accordance with this invention and formed on the same integrated cirucit chip. Here the input frequency is applied to a terminal 186 while the key switches are connected to key terminals 187 and 188. The frequency at terminal 186 is applied to NOR gates 189 and 190 and to the input of a flip-flop circuit 191. The output of flip-flop circuit 191 is connected to a second flip-flop 192 and to a pair of NOR gates 193 and 194. In like fashion, the output of flip-flop circuit 192 is applied to NOR gates 196 and 197. The NOR gates 189, 193 and 196 are enabled as a result of actuation of the key associated with terminal 187, which in turn, allows the audio-frequency signals thus developed to be applied to the output terminals 151, 152, and 153. This signal is delivered through associated series connected output reisistors 201, 202 and 203. The NOR gates 190, 194 and 197 are enabled as a result of actuation of the key associated with terminal 188 to provide transfer of the audio signal thus developed to output terminals 154, 155 and 156. Here again, the output frequency signals are applied through associated series connected resistors 208, 209 and 210, respectively. The NOR gates 190, 194 and 197 have their enableing lines connected to the output of an OR gate 211.

Figure 9:
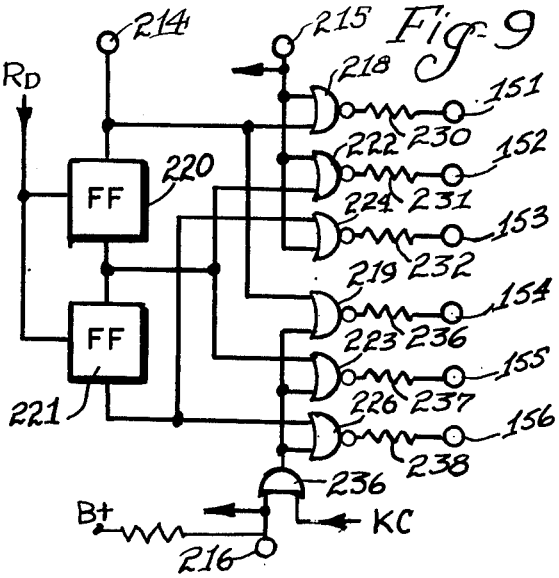
FIG. 9 is still another circuit configuration which can be formed in accordance with this invention and formed on the same integrated circuit chip as those illustrated in FIGS. 6, 7, and 8.

Referring now to FIG. 9 there is seen still another frequency divider circuit formed on the integrated circuit chip constructed in accordance with this invention. In this instance the fundamental frequency is applied to a terminal 214 while the key switch enabling signals are applied to terinals 215 and 216. The output signal from terminal 214 is applied to a pair of NOR gates 218 and 219 and to the input terminal of a flip-flop circuit 220. The output of flip-flop circuit 220 is applied to a second flip-flop circuit 221 and to a pair of NOR gates 222 and 223. The output of flip-flop circuit 221 is also applied to a pair of NOR gates 224 and 226. The NOR gates 218, 222 and 224 when enabled, apply output signals to terminals 151, 152 and 153 through their associated series connected resistors 230, 231 and 232, respectively. When NOR gates 219, 223 and 226 are enabled, as a result of actuation of the key associated with terminal 216, output signals are applied to output terminals 154, 155 and 156 through their respective series connected resistors 236, 237 and 238. The terminal 216 is connected to the enabling line of NOR gates 219, 223 and 226 through an OR gate 236.

Figure 10:
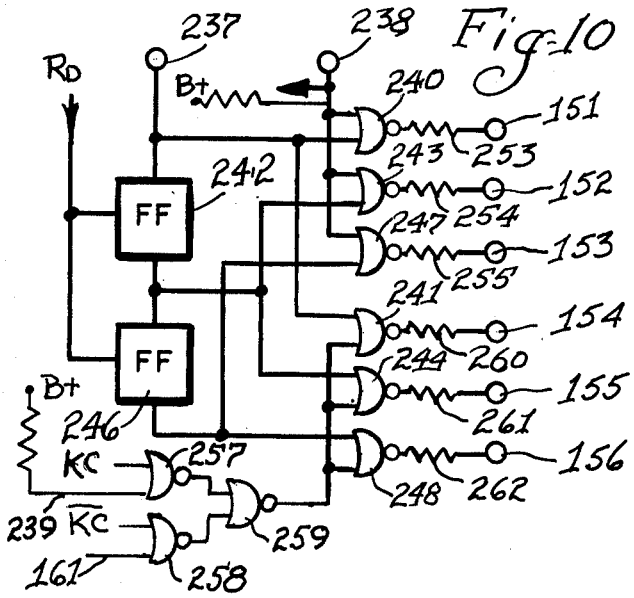
FIG. 10 is an alternate circuit configuration formed in accordance with the principles of this invention and formed on the same integrated circuit chip.

Referring now to FIG. 10 there is seen still another divider circuit constructed in accordance with the principles of this invention and which is formed as part of the single integrated circuit chip upon which the divider circuits of FIGS. 6, 7, 8 and 9 are formed. Here the input frequency is applied to a terminal 237 while the key actuated switches are connected to terminals 238, 239 and 161. The terminal 237 applies as a fundamental frequency to a pair of NOR gates 240 and 241 and to a flip-flop circuit 242. The first sub-harmonic is generated at the output of flip-flop circuit 242 and applied to NOR gates 243 and 244, and to the input of a second flip-flop circuit 246. A second sub-harmonic is generated at the output of flip-flop circuit 246 and applied to a pair of NOR gates 247 and 248. The NOR gates 240, 243 and 247 are enabled as a result of actuation of the key associated with the terminal 238 and thereby applies an output audio signal to terminals 151, 152 and 153 through their associated resistors 253, 254 and 255, respectively. NOR gates 241, 244 and 248 are enabled as a result of actuation of the key associated with terminal 239 or 161 depending on control KC thereby applying an output signal to terminals 154, 155 and 156 through their associated connected series resistors 260, 261 and 262. It will be noted that in this instance the enabling line associated with terminal 239 and 161 includes three NOR gates 257, 258 and 259.

If the KC signal is high and the $\overline{KC}$ signal low then the output of NOR gate 257 line 250 will always be a low level thus allowing the key switch input 161 to control NOR gates 241, 244 and 248. Meanwhile in FIG. 6 this same key switch input 161 does not control NOR gates 149, 144 and 148 because this same KC input high does not allow the key switch signal to pass through OR gate 162. If the KC control input was low and $\overline{KC}$ was high then key switch input 161 would control NOR gates 149, 144 and 148 in FIG. 6 and only key switch input 239 controls NOR gates 241, 244 and 248 of FIG. 10. Thus when KC is low the lower manual key switches control the same seven groups of frequencies as the upper manual. In this case both keyboards have no stagger or the lower keyboard can have a 12 note (one octave) stagger however the lower manual fundamental or footages are one octave higher than the upper keyboard. If the KC input is high then all frequencies for the lower keyboard are shifted up four notes, thus allowing for an eight note keyboard stagger with the lower keyboard footages being one octave higher.

Figure 11:
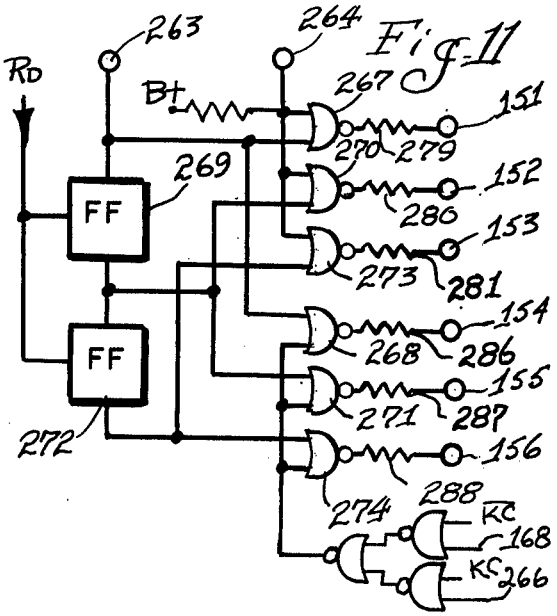
FIG. 11 is still another alternate configuration of the circuit constructed in accordance with the principles of this invention and formed on the same integrated circuit chip.

Referring not to FIG. 11 there is seen still another divider circuit constructed in accordance with this invention on a single integrated circuit chip. Here the input frequency is applied to a terminal 263 while key actuated signal information is applied to terminals 264 and 266 or 168. The signal information applied to terminal 263 is applied to a pair of NOR gates 267 and 268 and to a flip-flop circuit 269. The second harmonic is developed at the output of flip-flop 269 and delivered to a pair of NOR gates 270 and 271 and to the input of a second flip-flop circuit 272. The output of flip-flop circuit 272 generates the fundamental and is applied to a pair of NOR gates 273 and 274. The NOR gates 267, 270 and 273 are enabled as a result of actuation of the key associated with terminal 264, thereby allowing transfer of the audio-signal information from the NOR gates to output terminals 151, 152 and 153 through their associated series connected resistors 279, 280 and 281, respectively. The output of NOR gates 268, 271 and 274 is obtained as a result of actuation of the key associated with terminal 266, or 168, thereby allowing transfer of the audio-signal information to output terminals 154, 155 and 156 through their respective series connected resistors 286, 287 and 288. The KC and $\overline{KC}$ inputs controls which of the key switch inputs 266 or 168 controls the three outputs above.

Figure 14:
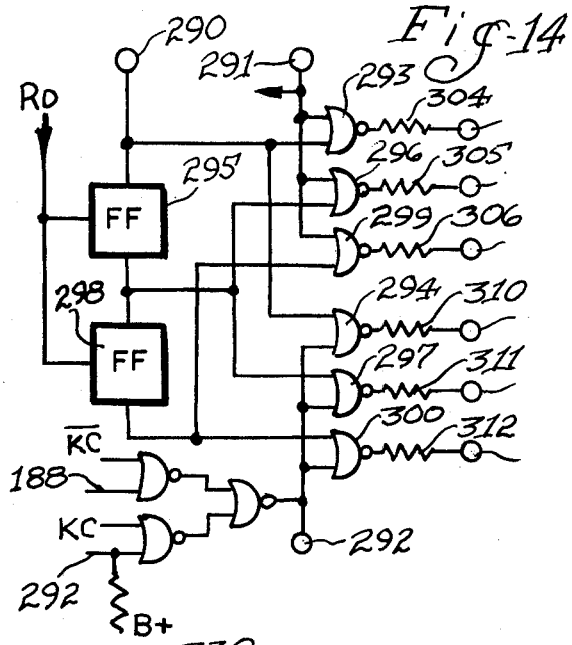
FIGS. 14, 15, 16, 17, 18, and 19 illustrate additional circuit configurations that are formed on the single large scale integrated circuit chip to achieve other frequencies for the electronic organ of this invention.

FIG. 14 illustrates still another divider network constructed in accordance with this invention and associated with the single integrated circuit chip. Here an input fourth harmonic frequency is applied to terminal 290 while key actuation is sensed at terminals 291 and 292 or 188. The frequency applied to terminals 290 is delivered to a pair of NOR gates 293 and 294 and to the input of a flip-flop circuit 295. The second harmonic is generated at the output of flip-flop circuit 295 and applied to a pair of NOR gates 296 and 297 and to the input of flip-flop circuit 298. The fundamental frequency is generated at the output of flip-flop 298 and is applied to NOR gates 299 and 300. When NOR gates 293, 296 and 299 are enabled as a result of actuation of the key associated with terminal 291, the output signal from the voltage divider network is applied to terminals 151, 152 and 153 through their associated series connected resistors 304, 305 and 306, respectively. When the key associated with terminal 292 or 188 is actuated, NOR gates 294, 297 and 300 are enabled to deliver to output terminals 154, 155 and 156 the audio-signals thus developed. In similar fashion, the audio-signals are delivered to these output terminals through their series connected resistors 310, 311 and 312, respectively. Again 292 controls these outputs if KC is low and key switch 188 controls these outputs if KC is high.

Figure 15:
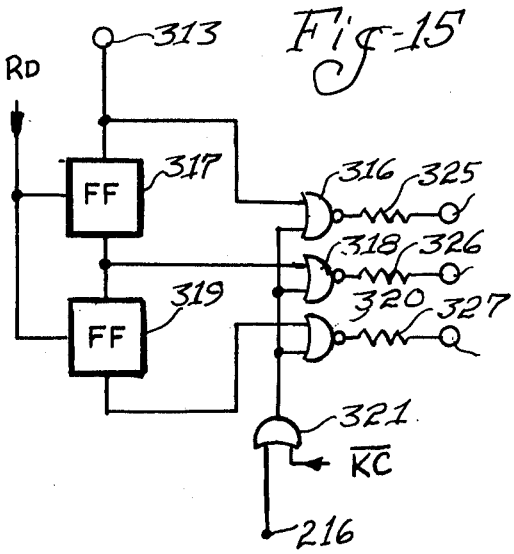

Referring now to FIG. 15 there is seen a somewhat simplified divider network constructed in accordance with the principles of this invention and which is formed as part of the single integrated circuit chip associated with the divider circuits of FIGS. 6–11 and 14. Here the input frequency is applied to a terminal 313 while the key switch is associated with the terminal 216 from FIG. 9. The frequency at terminal 313 is applied to a NOR gate 316 and to the input of a flip-flop circuit 317. The second harmonic is generated at the output of flip-flop circuit 317 and applied to a NOR gate 318 and to the input of a flip-flop circuit 319. The second sub-harmonic is generated at the output of flip-flop circuit 319 and applied to a NOR gate 320. The NOR gates 316, 318 and 320 are enabled as a result of a signal delivered through an OR gate 321 when the key associated with terminals 216 is actuated and $\overline{KC}$ input is low. The outputs of NOR gates 316, 318 and 320 are applied to terminals 154, 155 and 156 through their series connected resistors 325, 326, and 327, respectively.

Figure 16:
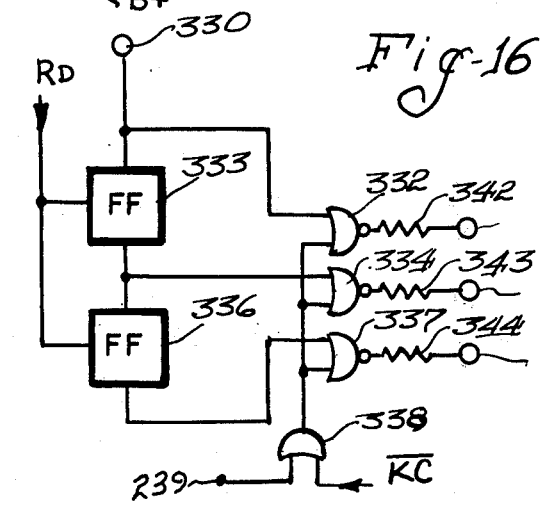

Referring now to FIG. 16 there is seen another divider circuit constructed in accordance with this invention and forms part of the same integrated circuit chip as that of FIG. 15. Here the input frequency is applied to a terminal 330 while the key actuated switch is associated with a terminal 239 of FIG. 10. The frequency delivered to terminal 330 is applied to a NOR gate 332 and to the input of a flip-flop circuit 333. The second harmonic is developed at the output of flip-flop 333 and applied to a NOR gate 334 and to the input of a second flip-flop circuit 336. The fundamental developed at the output of flip-flop circuit 336 is applied to a NOR gate 337. The NOR gates 332, 334 and 337 are enabled as a result of the output signals developed at OR gate 338 which, in turn, allows the audio signal frequency to be transferred through the NOR gates to the output terminals 154, 155 and 156. This transfer of audio signal information takes place through the series connected resistors 342, 343 and 344, respectively whenever key switch 239 is actuated and $\overline{KC}$ is low.

Figure 17:
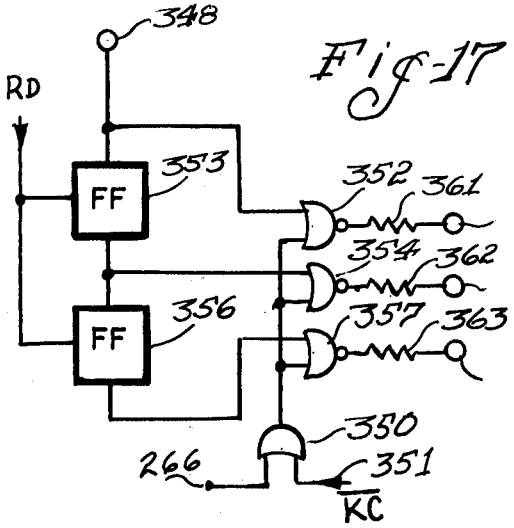

Referring now to FIG. 17 there is seen a divider circuit constructed in accordance with the principles of this invention and which is formed within the same integrated circuit chip as the circuits illustrated in FIGS. 6–11 and 14-16. Here the input frequency is applied to a terminal 348 while a key switch is connected to the terminal 266 of FIG. 11. The key switch is associated with one input of an OR gate 350 which, in turn, has the other input thereof arranged for connection to the control input $\overline{KC}$ along line 351. The frequency applied to terminal 348 is applied to a NOR gate 352 and to an input of flip-flop circuit 353. The output of flip-flop circuit 353 produces the second harmonic which, in turn, is applied to a NOR gate 354 and to the input of a second flip-flop circuit 356. The output of flip-flop circuit 356 is applied to a NOR gate 357. Each of the NOR gates 352, 354 and 357 are connected to output terminals 154, 155 and 156, respectively, through theri associated series connected resistance elements 361, 362 and 363.

Figure 18:
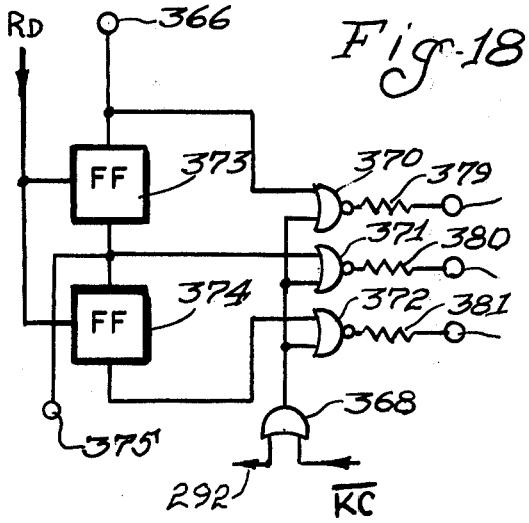

Referring now to FIG. 18 there is seen still another circuit configuration of a divider network which is formed as part of the integrated circuit chip of this invention. Here the base frequency is applied to a terminal 366 while the key signal is applied to terminal 292 of FIG. 14 which, in turn, is associated with one input of an OR gate 368. The NOR gate 368 provides an enabling signal to the inputs of the NOR transfer gates 370, 371 and 372. The base frequency at terminal 366 is applied to NOR gate 370 and to a filp-flop circuit 373 which, in turn, generates the second harmonic to be delivered to the NOR gate 371. Also the output of flip-flop circuit 373 is applied to the input of flip-flop circuit 374 which, in turn, has its output connected to NOR gate 372. The signals developed through the NOR gates 370, 371 and 372 are applied to output terminals 154, 155 and 156 through their associated series connected resistors 379, 380 and 381, respectively. This circuit also provides one-half of the input frequency (of high E at terminal 366) at output terminal 375.

Figure 19:
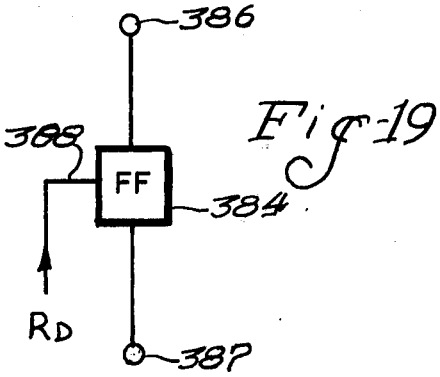

FIG. 19 illustrates but a single divider network which is a divide-by-two flip-flop circuit 384 having an input terminal 386 and an output terminal 387. A reset line is indicated at 388 and recieves a reset signals to reset the flip-flop. It will be noted that in all of the other figures the reset line $R_D$ is used to reset the flip-flop of each of the divider circuits. This circuit provides one-half the frequency of the F note.

It will be understood that the resistance value of all of the output resistors is the same and preferably in the order of about 20,000 ohms.

Figure 12:
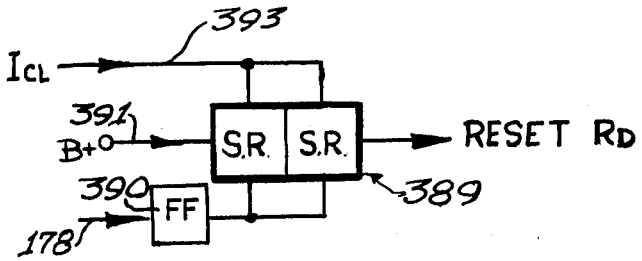
FIG. 12 is a simplified circuit configuration illustrating means for producing reset pulses for the various divider networks illustrated herein.

FIG. 12 illustrates the dual stages shift register as in FIG. 5 which can be used to generate the reset signal $R_D$ used for resetting all dividers in this LSI circuit. The shift register includes an input line 178 which receives the frequency output of FIG. 6. This goes through a divide-by-four block 390 resulting in a shift register clock signal of input 140 divided-by-sixteen. A voltage is applied to a line 391 to represent a logic-one level. A reset line 393 is applied to the shift register 389 and is used to reset the shift register to a logic-zero level when a reset pulse of a logic-one level is applied thereto. If this input 393 is held off long enough to obtain 32 counts of input 140 then reset line $R_D$ will go to a one level resetting all dividers in this chip.

Figure 13:
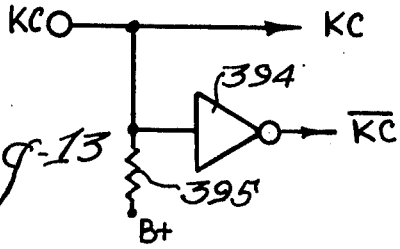
FIG. 13 illustrates a control circuit for controlling the operation of various divider networks of FIGS. 6–11 and 14 through 18.

FIG. 13 illustrates means for obtaining the D.C. control signal of one polarity and a similar D.C. control signal of an opposite polarity, these control signals being designated by KC and $\overline{KC}$. The $\overline{KC}$ pulse is developed at the output of an inverter circuit 394 and operates substantially in the same manner as the circuit illustrated in FIG. 4. The inverter circuit has its input connected to the B+ potential through resistor 395. For example, the KC output of the circuit of FIG. 13 is applied to the second input line of OR gates 162, 181, 211, and 236 and NOR gates 257, 277 and 301 of FIGS. 6, 7, 8, 9, 10, 11 and 14, respectively. On the other hand, the $\overline{KC}$ signal is applied to the second input of OR gates 321, 338, 350 and 368 of FIGS. 15, 16, 17 and 18, and NOR gates 258, 276 and 302 of FIGS. 10, 11 and 14, respectively. This circuit is formed as part of the large scale integrated circuit chip.

Figure 20:
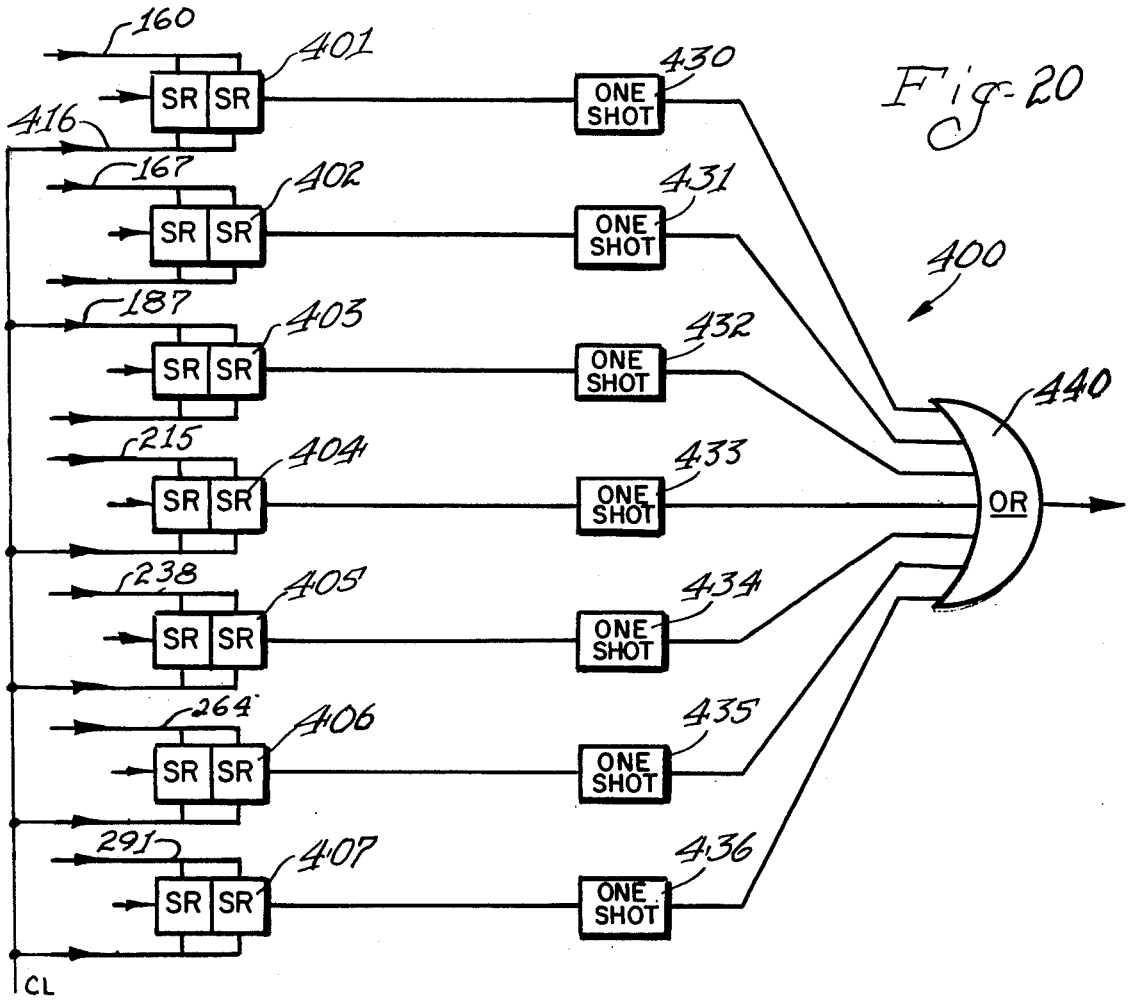
FIG. 20 illustrates an OR gate and a plurality of parallel connected shift registers and one-shot multivibrators which can be formed on the integrated circuit chip which forms the circuits of FIGS. 6–19 (except for 12 and 13). This circuit configuration produces pulse signal information corresponding to a key on the upper keyboard.
Figure 21:
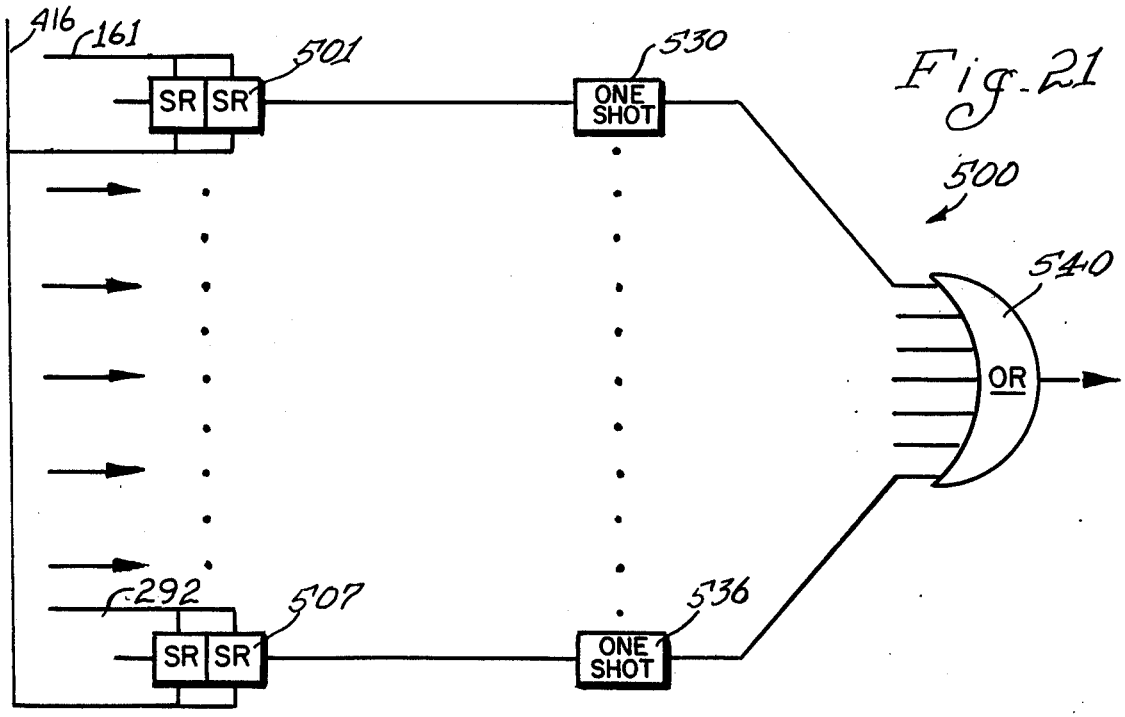
FIG. 21 illustrates still another circuit configuration of an OR gate and shift register with series connected one-shot multivibrators in accordance with the principles of this invention, and this circuit produces pulse signal information corresponding to a key from the lower keyboard.

Referring now to FIG. 20 there is seen a circuit which will produce a pulse output, similar to that shown in FIG. 5, but which pulse output will be responsive to actuation of key switches associated with terminals 160, 167, 187, 215, 238, 264 and 291. On the other hand, the circuit configuration shown in FIG. 21 is used to develop pulse signals corresponding to the actuation of keys associated with terminals 161, 168, 188, 216, 239, 266 and 292. The pulse output circuit of FIG. 20 is designated generally by reference numeral 400 and includes a plurality of shift registers 401, 402, 403, 404, 405, 406 and 407. The shift registers 401–407 each have an input line from the key switch inputs 160, 167, 187, 215, 238, 264 and 291, respectively. The clock pulse for the shift registers is applied to the line 416 going to all the shift registers of FIG. 20 and 21. The output of each of the shift registers upon key closure is a D.C. voltage change and therefore is applied to an associated one-shot multivibrator circuit 430, 431, 432, 433, 434, 435 and 436. The output of the one-shot multivibrator circuits 430–436 is a short pulse delivered to a seven-input OR gate 440 which, in turn, has its output coupled to an appropriate circuit to develop the necessary pulse output for operation of such things as percussion circuits. This additional circuit is the same as shown by blocks 124, 126, 130, 131, 137, 138 and 139 of FIG. 5.

Finally, the pulse output circuit of FIG. 21 is substantially the same as that of FIG. 20 but used to cooperate with the lower manual key switch inputs. Here a plurality of shift registers 501–507 are associated with the circuit 500 and in like manner have their corresponding key operated switch lines 161, 168, 188, 216, 239, 266 and 292 associated therewith and the same clock pulse line 416. The output of the shift registers 501–507 is delivered to one-shot multi-vibrators 530–536. The output of the one-shot multivibrators 530–536 is delivered to a seven-input OR gate 540 and operates substantially in the same manner as the seven-input OR gate 440 of FIG. 20. The circuit configurations illustrated in FIGS. 20 and 21 are formed on the same integrated circuit chip as the circuit configuration associated with FIGS. 6–19.

It will be understood that in all of the circuit arrangements illustrated above, the NOR gate circuits associated with the dividers may be AND gate circuits.

Figure 6:
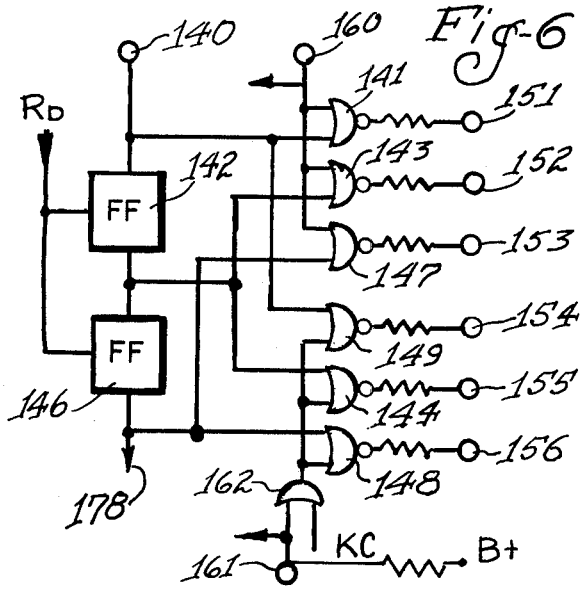
FIG. 6 is an alternate form of frequency divider circuit which can be formed on a single integrated circuit chip in accordance with the principles of this invention, and used to provide audio-frequency signal information for an electronic organ.
Figures 6, 7, 8, 9, 10, 11, 14, 15, 16, 17, 18, 19, 22:
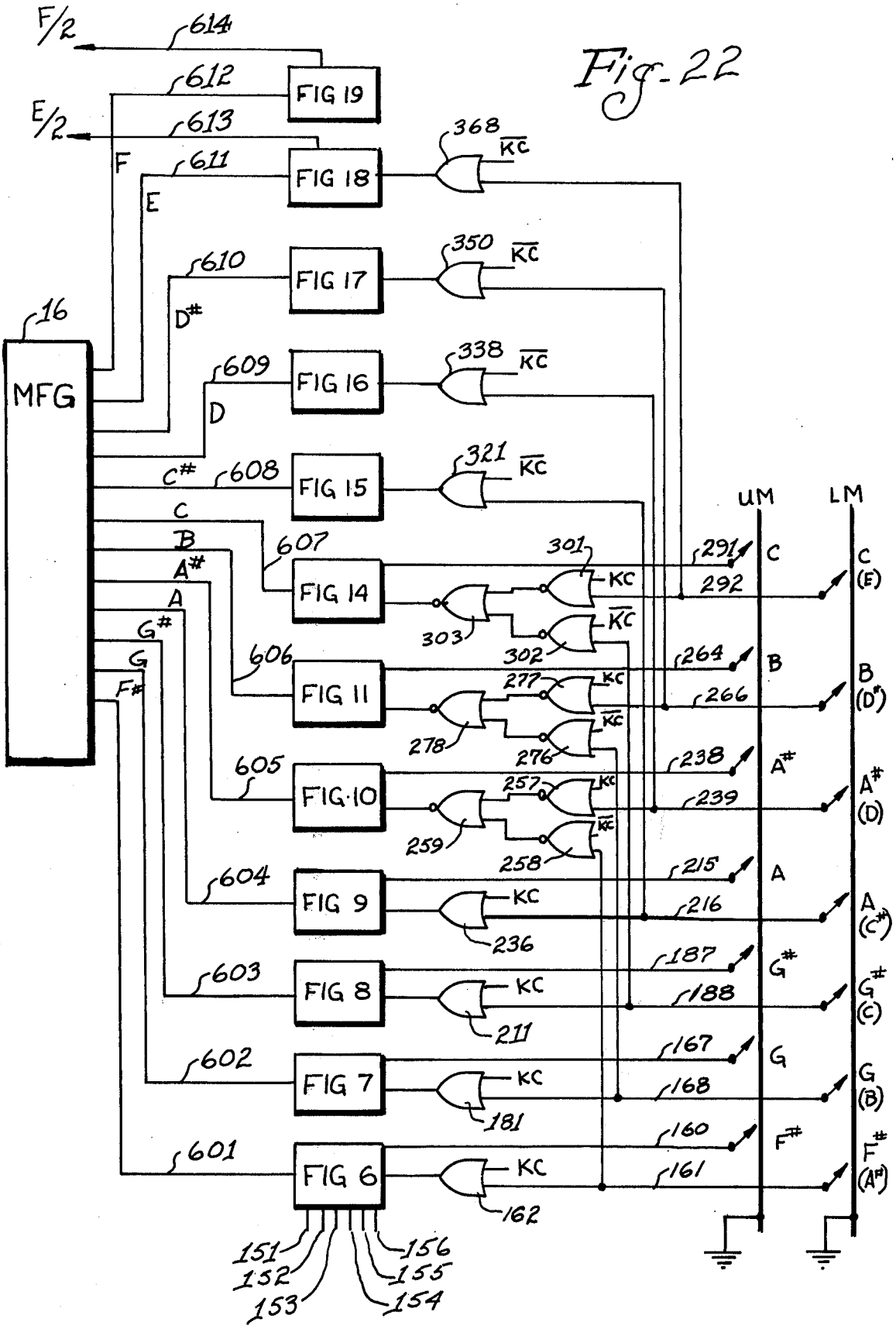
FIG. 22 is a partial circuit arrangement which shows how the divider circuits are used to develop 7 notes for the upper and 7 notes for the lower manuals of a two manual keyboard. Adding this circuit to two pair of circuits of FIG. 1 will convert a dual 37 note manual into a dual 44 note manual.

FIG. 22 illustrates a circuit arrangement which utilizes the divider circuits of FIGS. 6, 7, 8, 9, 10, 11, 14, 15, 16, 17, 18 and 19 to generate some of the notes required of the upper and lower keyboards of a two manual organ. The multi-frequency generator 16 has an F sharp note frequency connected to the circuit of FIG. 6 over a line 601 to the input terminal 140. A key switch line 160 is connected to the F sharp note key of the upper manual key switch arrangement so that three footages of the F sharp note generated within the circuit arrangement of FIG. 6 is applied to the audio output lines 151, 152 and 153. The F. sharp frequencies for the lower manual keyboard of the organ is obtained when the key switch 161 is closed through the OR gate circuit 162 when the KC control input is low. The F sharp key switch of the lower manual keyboard is also connected to one input of a NOR gate 258 associated with the divider circuit of FIG. 10. The F sharp key switch is an A sharp key switch if KC is high and the frequencies of FIG. 10 (A sharp) are actuated through NOR gates 258 and 259. A G note frequency is obtained from the multi-frequency generator 16 over a line 602 and applied to the divider circuit illustrated by FIG. 7. This G note frequency is applied to the audio output circuits 151, 152 and 153 when the upper manual G switch is closed and to the audio outputs 154, 155 and 156 when the lower manual G switch is closed and KC is low. Again, it will be noted that the lower manual G switch is connected to the divider circuit of FIG. 7 through an OR gate 181. Thhe A note frequency obtained from the multi-frequency generator 16 is applied to the circuit arrangement of FIG. 9 over a line 603. Actuation of either the upper manual or lower manual A key switches will produce audio outputs. The lower manual key switch is connected to the divider circuit of FIG. 9 through an OR gate 236. The A sharp output from the multi-frequency generator is delivered over a line 604 to the divider circuit of FIG. 10. The divider circuit of FIG. 10 will produce outputs when either of the A sharp keys of the upper and/or lower keyboards is actuated. The key associated with the lower manual is connected to the circuit of FIG. 10 through a pair of series connected NOR gates 257 and 259.

The B note frequency is delivered over line 606. The C note frequency from the multi-frequency generator is delivered over line 607 to the divider circuit of FIG. 12 and produces an output when either of the C note keys of the upper and lower manual are actuated. The C note key of the upper manual is connected to the divider of FIG. 12 directly over a line 291 while the C note key of the lower manual is connected to the divider of FIG. 12 over a line 292 and a pair of series connected NOR gates 301 and 303 when KC is low and over line 188 and through gates 302 and 303 if KC is high. The C sharp note frequency from the multi-frequency generator 16 is delivered to the divider circuit of FIG. 15 over a line 608 and to the inputs of the audio-amplifier when the C sharp key of the lower manual is actuated, and KC is high. However, the output of FIG. 15 is also produced when the A key which becomes the C sharp key of the lower manual is actuated as this key is connected to the divider circuit over a line 216 through an OR gate 321. This is when the KC control input is high.

The multi-frequency generator 16 applies an E note frequency to the divider of FIG. 18 and this frequency is divided in half and delivered over a line 613 to the E note of the next lower octave. The divider circuit of FIG. 18 is also connected to the C key of the lower manual keyboard over a line 292 and OR gate 368. Finally, the F note frequency from the multi-frequency generator 16 is applied to the circuit arrangement of FIG. 19 over a line 612 and this circuit produces the lower octave F note over a line 614. As mentioned above, FIGS. 18 and 19 produce the base frequency divided by one-half at terminals 375 and 387, respectively.

Accordingly, the present invention provides an integrated circuit construction which has a multitude of divider circuits and pulse circuits incorporated therein to obtain a plurality of audio-signal frequencies which are of a character having the fundamental frequency and at least two sub-harmonics associated therewith to produce a desired audio-tone for the electronic organ. By so providing the electronic organ of this type with integrated circuit configurations as those illustrated herein, a substantially inproved organ structure is obtained while greatly reducing the cost thereof. While several specific circuit configurations have been illustrated herein, it will be understood that a multitude of other circuit configurations can be incorporated without departing from the spirit and scope of the novel concepts disclosed and claimed herein.

The invention is claimed as follows:

1. An electronic musical instrument comprising: a multi-frequency generator for generating a plurality of different frequency signals, first circuit means coupled to said multi-frequency generator for providing harmonic frequencies of said plurality of different frequencies, second circuit means coupled to said first circuit means for combining at least one of said harmonic frequencies with a selected one of said frequency signals from said multi-frequency generator means, electroacoustic transducer means for receiving the combined signals and reproducing the same, and third circuit means coupled to said second circuit means, and responsive to said selected one of said frequency signals for producing a pulse output as a result of the selection thereof for energizing independent electronic circuitry associated with said electronic musical instrument.

2. An electronic musical instrument as set forth in claim 1 wherein harmonic frequency combined with the frequency signal from said multi-frequency generator is a subharmonic of the frequency combined therewith.

3. An electronic musical instrument as set forth in claim 1 wherein said second circuit means includes a plurality of output terminals each including a resistance element of the same value connected thereacross.

4. An electronic musical instrument as set forth in claim 1 wherein said second circuit means includes a plurality of gate circuits.

5. In an electronic musical instrument having a plurality of manually operated keys and a plurality of switch means respectively operable thereby to energize electro-acoustic transducing means, the combination comprising: multi-frequency generating means for generating a plurality of different frequency signals to be associated with selected ones of a plurality of tones to be produced by the electroacoustic transducing means, circuit means connected to said multi-frequency generating means and having a plurality of digital signal processing electronic eomponents arranged to form a plurality of frequency divider networks and a plurality of digital control circuits associated with said frequency divider networks, each divider network and its associated plurality of digital control circuits being adapted to provide a digital rectangular pulse train whose repetition rate corresponds to the frequency of a given musical tone, said digital control circuits being interconnected with said key operable control means, said frequency divider network and said electro-acoustic transducer means.

6. In the electronic musical instrument as set forth in claim 5, wherein said circuit means is an integrated circuit.

7. In the electronic musical instrument as set forth in claim 5 and further including a mixing circuit and a plurality of resistance elements connected between said frequency divider networks and said mixing circuit.

8. In the electronic musical instrument as set forth in claim 7 wherein the resistance values of said plurality of resistance elements are on the order of 10,000 to 30,000 ohms.

9. In the electronic musical instrument as set forth in claim 5, wherein said digital signal processing components include a plurality of digital gating elements.

10. In an electronic musical instrument having a plurality of manually operated keys and a plurality of key switches respectively operable thereby to energize electroacoustic transducer means, the combination comprising: a large scale integrated circuit chip having first circuit means for developing a plurality of different audio frequencies to be reproduced by said electroacoustic transducer means, each of said audio-frequencies being electronically developed in response to actuation of assoicated ones of said plurality of key switches, second circuit means to be operatively connected to each one of the plurality of key switches and responsive to the actuation thereof for producing a pulse output as a result of the actuation of any one of said plurality of key switches, and third circuit means forming a summing gate for receiving said pulse output of said second circuit means whereby said pulse output signal can be used to energize independent electronic circuitry associated with the electronic musical instrument, said second circuit means forming a plurality of shift registers to be operatively coupled to said plurality of key switches to provide a time delayed output pulse through said summing gate.

11. The electronic musical instrument as set forth in claim 10, wherein said shift registers include means for adjusting said time delay of said output pulse after a selected one of said plurality of key switches is closed to eliminate the possibility of erroneous signals occurring as a result of contact bounce obtained by actuation and release of the key switches.

12. The electronic musical instrument of claim 10, further including multi-frequency generator means associated with said large scale integrated circuit, to provide a base frequency at an input of each one of a plurality of frequency developing circuits formed in said first circuit means, said frequency developing circuits operating upon said base frequency to provide a different audio frequency for each of said plurality of keys.

13. In an electronic musical instrument having a plurality of manually operated keys and a plurality of key switched respectively operated thereby to energize electro-acoustic transducing means, the combination comprising: multi-frequency generating means for generating a plurality of different frequency signals to be associated with selected ones of a plurality of tones to be produce bu the electro-acoustic transducing means, a plurality of input terminals arranged for connection to said ,multi-frequency generating means, circuit means having a first multitude active electronic components arranged to form a plurality of frequency divider networks and a second multitude of active electronic components arranged to form a plurality of gate circuits to be associated with said frequency divider networks, each divider network and its associated plurality of gate circuits adapted to provide a given musical tone which includes the fundamental frequency and at least one subharmonic or second harmonic, said plurality of gates being arranged in groups and having one input thereof connected to the output of its associated divider circuit and another input thereof connected in common with other inputs of the gate within said group, said other input also being connected to said key switch to enable said gate of said group to effect a transfer of the audio signals from said divider network into said electro-acoustic transducint means, a plurality of output terminals associated with said circuit means and coupled to the output of said gates, and said passive electronic components including resistance elements connected between the output of said plurality of gates and said output terminals.

14. In the electronic musical instrument as set forth in claim 13, wherein said circuit means is an integrated circuit.

15. In the electronic musical instrument as set forth in claim 13, wherein said plurality of resistance elements connected between said output of said plurality of gates and said output terminals are of the same resistance value.

16. In the electronic musical instrument as set forth in claim 15, wherein the resistance value of said plurality of resistance elements is in the order of about 10,000 to 30,000 ohms.

17. In the electronic musical instrument as set forth in claim 13, wherein said plurality of gate circuits are NOR gate circuits.

18. In the electronic musical instrument as set forth in claim 13, wherein said frequency divider networks are formed of a plurality of divide-by-two flip-flop circuits.

19. An electronic musical instrument having a plurality of key operable control means adapted to energize electro-acoustic transducing means, comprising in combination: a large scale integrated circuit chip having formed thereon frequency input terminals, frequency output terminals, and a plurality of keying terminals, said keying terminals being responsive to the actuation of an associated one of said plurality of key operated control means to effect audio frequency signals at said frequency output terminals, said integrated circuit chip having a plurality of digital processing circuits for producing the audio-output signal, each of said digital processing circuits including, a first logic gate having first and second inputs and a first output, a second logic gate having third and fourth inputs and a second output, a third logic gate having fifth and sixth inputs and a third output, first and second series connected flip-flop circuits, said first input of said first logic gate and the input of said first flip-flop circuit being coupled to a selected one of said frequency input terminals to receive a first predetermined fundamental frequency, the output of said first flip-flop circuit being coupled to said third input of said second logic gate thereby providing a first sub-harmonic of said first predetermined fundamental frequency, said second flip-flop circuit having its output coupled to said fifth input terminal of said third logic gate thereby providing a second sub-harmonic of said first fundamental frequency, said second, fourth, and sixth inputs of said first, second, and thrid logic gates, respectively, predetermined key operated control means with said first fundamental frequency, whereby actuation of said key operated control means will enable said first, second, and third logic gates to effect a transfer of the fundamental, first sub-harmonic and second sub-harmonic frequencies to apply said composite audio-output signal to the electro-acoustic transducer means associated with the electronic musical instrument.

20. An electronic musical instrument having a plurality of key switched adapted to energize electro-acoustic transducing means, comprising in combination: a large scale integrated circuit chip having formed thereon a plurality of frequency input terminals, a plurality of frequency output terminals, and a plurality of keying terminals, said keying terminals being responsive to the actuation of an associated one of said plurality of key switches to effect a composite audio output signal at certain ones of said plurality of frequency output terminals, said integrated circuit chip having a plurality of tone developing circuits for producing the composite audio-output signal, each of said tone developing circuits including, a first NOR gate having first and second inputs and a first output, a second NOR gate having third and fourth inputs and a second output, a third NOR gate having fifth and sixth inputs and a third output, first and second series connected flip-flop circuits, said first input of said first NOR gate and the input of said first flip-flop circuit being coupled to a selected one of said plurality of frequency input terminals to receive a first predetermined fundamental frequency, the output of said first flip-flop circuit being coupled to said third input of said second NOR gate thereby prociding a first sub-harmonic of said first predetermined fundamental frequency, said second flip-flop circuit having its output coupled to said fifth input terminal of said third NOR gate thereby providing a second sub-harmonic of said first fundamental frequency, said second, fourth, and sixth inputs of said first, second, and third NOR gates, respectively, connected to a predetermined key switch associated with said first fundamental frequency, whereby actuation of said key switch will enable said first, second, and thrid NOR gates to effect a transfer of the fundamental, first sub-harmonic and second sub-harmonic frequencies to apply said composite audio-output signal to the electro-acoustic transducer means associated with the electronic musical instrument.

21. The electronic musical instrument as set forth in claim 20, wherein said tone developing circuit further includes a fourth NOR gate having seventh and eighth input terminals and a fourth output terminal, a fifth NOR gate having ninth and tenth input terminals and a fifth output terminal, and a sixth NOR gate having eleventh and twelfth input terminals and a sixth output terminal, said seventh input terminal receiving the output of said first flip-flop circuit which functions as a second fundamental frequency one octave lower than said first fundamental frequency, said ninth input terminal connected to the output of said second flip-flop circuit to produce the first sub-harmonic of said second fundamental frequency delivered to said fourth NOR gate, and a third flip-flop circuit connected in series with said first and second flip-flop circuits, said third flip-flop circuit having the output thereof connected to said eleventh input terminal of said sixth NOR gate to provide the second sub-harmonic of said second fundamental frequency developed within said fourth NOR gate, said eighth, tenth, and twelfth input terminals of said fourth, fifth, and sixth NOR gates being connected to a second predetermined key switch associated with said second predetermined fundamental frequency, said second predetermined key switch being displaced from said first predetermined key switch by one octave.

22. The electronic musical instrument as set forth in claim 21, further including a seventh NOR gate having thirteenth and fourteenth inputs and a seventh output, an eighth NOR gate having fifteenth and sixteenth inputs and an eighth output, and a ninth NOR gate having seventeenth and eighteenth inputs and a ninth output, and a fourth flip-flop circuit connected in series with said first, second, and third flip-flop circuits, said thirteenth input recieving the output signal from said second flip-flop circuit to generate third fundamental frequency displaced from said first fundamental frequency by two octaves, said fifteenth input being connected to the output of said third flip-flop circuit to develop the first sub-harmonic of said third fundamental frequency, said seventeenth input being connected to the output of said fourth flip-flop circuit to develop a second sub-harmonic of said second fundamental frequency, said fourteenth, sixteenth, and eighteenth input terminals being connected to a third predetermined key switch associated with said third fundamental frequency said third predetermined key switch being displaced from said second predetermined key switch by one octave.

23. The electronic musical instrument according to claim 20, wherein said first, second, and third outputs of said first, second, and third NOR gates are coupled to their associated frequency output terminals through fixed resistors which comprise the passive electronic components formed on the large scale integrated circuit chip.

24. The electronic musical instrument as set forth in claim 23 wherein said fixed resistance elements have a resistance value in the order of about 10,000 to 30,000 ohms.

* * * * *